US005279025A

United States Patent [19]

Kinast

[11] Patent Number: 5,279,025

[45] Date of Patent: Jan. 18, 1994

[54] METHOD OF SECURING A CAP ASSEMBLY TO A RADIATOR

[76] Inventor: Leonard L. Kinast, 39239 Polo Club Dr., Apt. 105, Farmington Hills, Mich. 48124

[21] Appl. No.: 850,011

[22] Filed: Mar. 10, 1992

Related U.S. Application Data

[60] Continuation of Ser. No. 654,953, Feb. 13, 1991, abandoned, which is a division of Ser. No. 554,188, Jul. 13, 1990, Pat. No. 5,011,040.

[51] Int. Cl.[5] ..... B23P 11/02; B65D 55/16

[52] U.S. Cl. ..... 29/436; 29/33 G; 29/450; 220/375

[58] Field of Search ..... 29/235, 434, 436, 450, 29/888.3, 33; 220/375, 376, 203

[56] References Cited

U.S. PATENT DOCUMENTS

| | | | |
|---|---|---|---|
| 1,371,669 | 3/1921 | Davis | 220/203 |
| 1,509,796 | 9/1924 | Tokuhisa | 220/375 X |
| 1,711,287 | 4/1929 | Schlaich | 220/375 |
| 1,749,462 | 3/1930 | Behnke | 220/375 |
| 1,756,976 | 5/1930 | Ehlers . | |
| 2,563,847 | 8/1951 | Keys | 220/203 |
| 2,729,359 | 1/1956 | Gugeler . | |
| 4,113,138 | 9/1978 | Field et al. | 220/375 X |
| 4,193,575 | 3/1980 | Burgess | 220/375 X |
| 4,872,587 | 10/1989 | Zimmerman et al. | 220/375 |
| 4,905,863 | 3/1990 | Blomquist et al. | 220/375 |

FOREIGN PATENT DOCUMENTS

| | | | |
|---|---|---|---|
| 1253868 | 1/1961 | France | 220/375 |

*Primary Examiner*—Mark Rosenbaum
*Assistant Examiner*—Peter D. Vo
*Attorney, Agent, or Firm*—Harness, Dickey & Pierce

[57] ABSTRACT

A radiator cap assembly has a cap, a tether and a seal member. The seal member is adapted to float upon coolant within the radiator. Upon removal of the cap while the coolant is in an elevated temperature and pressure condition, the seal member will cover the f ill tube to prevent liquid from exiting the radiator.

3 Claims, 1 Drawing Sheet

METHOD OF SECURING A CAP ASSEMBLY TO A RADIATOR

This is a continuation of U.S. patent application Ser. No. 654,953, filed Feb. 13, 1991 now abandoned, which is a divisional of Ser. No. 554,188, filed Jul. 13, 1990 now U.S. Pat. No. 5,011,040.

BACKGROUND AND SUMMARY OF THE INVENTION

The present invention relates to automotive vehicles and, more particularly, to radiator caps for automotive vehicles or any liquid cooling system radiators.

Generally, automotive vehicles are liquid-cooled by a recirculation radiator. The radiator holds fluid, ordinarily a mixture of antifreeze and water, which is circulated through the engine block to dissipate heat from the engine block into the fluid. The fluid is passed back into the radiator where ordinarily a fan is forcing air through the coils or tubes cooled by "fins" of the radiator to dissipate heat from the fluid into the ambient surroundings. Ordinarily, fluid lines from the vehicle's transmission are passed through the radiator to dissipate heat from the transmission into the radiator fluid.

In the process of dissipating heat from the engine and transmission, the fluid within the radiator increases in temperature. Since the radiator is generally in a closed system, the pressure within the radiator begins to build. Ordinarily, this is not a problem since the radiator is designed to function under increased temperatures and elevated pressures.

Sometimes it is necessary to examine the radiator by opening its cap. It is important that the cap is removed when the radiator and engine are cold. When the engine and radiator are cold, the pressure and temperature of the cooling fluid is low and the radiator cap is easily removed. However, since heat and pressure dissipation within the radiator and engine is a slow process, a mechanic or vehicle owner cannot always be sure that the radiator and engine have properly cooled. If, the cap is removed when the engine is still relatively hot, there is a probability that fluid loss will result. Thus, it is desirous to have a system which prevents radiator fluid loss in the event the radiator is opened when elevated fluid temperatures and pressure exist within the radiator.

Accordingly, it is an object of the present invention to provide a radiator cap assembly which prevents escape of fluid at an elevated temperature and pressure. It is an object of the present invention to provide the art with a simple, relatively inexpensive radiator cap assembly which seals the radiator in the event of radiator cap removal while the coolant fluid within the radiator is at an elevated temperature and pressure. The radiator cap assembly provides a seal tethered from the radiator cap which is floatable upon the coolant fluid within the radiator.

From the following detailed description taken in conjunction with the accompanying drawings and subjoined claims, other objects and advantages of the present invention will become apparent to those skilled in the art.

DETAILED DESCRIPTION OF THE PREFERRED EMBODIMENT

Figure 1:
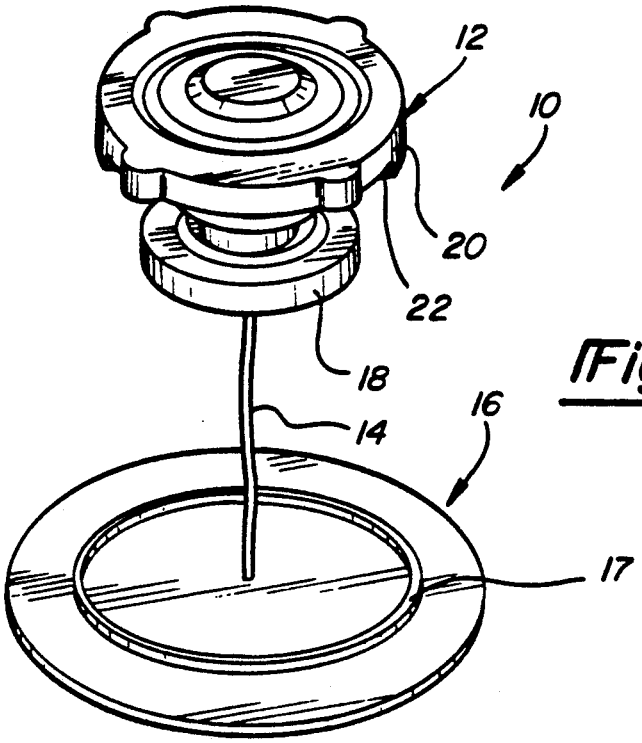
FIG. 1 is a perspective view of a radiator cap assembly in accordance with the present invention.

Referring to the figures, particularly FIG. 1, a radiator cap assembly is illustrated and designated with the reference numeral 10. The radiator cap assembly 10 generally includes a cap 12, tether 14 and seal member 16.

Figure 2:
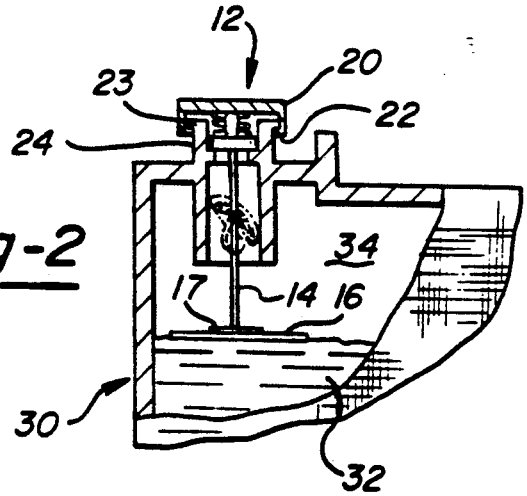
FIG. 2 is a side elevation view of the radiator cap assembly of FIG. 1 associated with a portion of a radiator shown in cross-section.

The cap 12 is like conventional radiator caps having a stopper 18 and a downward extending skirt 20 with a partial inward radial flange 22 adapted to secure the cap 12 to a flange 23 on a radiator fill tube 24, as seen in FIG. 2.

The tether 14 is securely affixed at one end to the stopper 18 of the cap 12. The tether 14 is a flexible cord member formed from a desired material. The tether 14 may be of an elastomeric, polymeric, rope, chain or the like material which will withstand the heat and pressure within the radiator without decomposing in the radiator. The other end of the tether is permanently affixed to the seal member 16.

The seal member 16 is disk-shaped and generally coupled with the tether 14 at its center, however, the seal member 16 may be of any desired configuration. The seal member 16 is of a flexible, resilient material such as rubber or any other type of flexible polymeric or elastomeric material. The disk member 16 has a size so that it will overlap the fill tube 24 when the disk is inserted into the radiator 30. The disk 16 is designed to float upon the coolant fluid 32, as illustrated in FIG. 2. Also, the seal member 16 may have one or more concentric annular ridges 17 extending therefrom to enhance sealing of the radiator fill tube 24. Thus, the tether 14 is of a desired length enabling the seal member 16 to hang into the radiator 30 and float upon the coolant fluid 32, as seen in FIG. 2.

Figure 3:
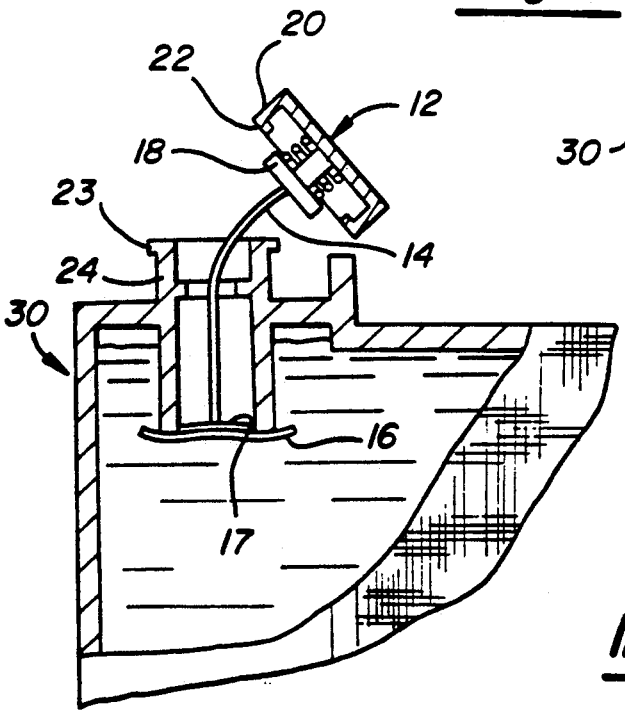
FIG. 3 is a view like that of FIG. 2 with the seal in a sealing position.

Turning to FIG. 3, the seal member 16 is illustrated in a sealing position on the fill tube 24 of the radiator 30. When the cap 12 is removed from the fill tube 24 and the radiator fluid 32 is at an increased temperature and pressure, the seal member 16 is urged to exit the fill tube 24 by the fluid. The seal member 16 contacts and surrounds the interior end portion of the fill tube 24 effectively sealing the fill tube 24 against expulsion of fluid within the radiator 30, as seen in FIG. 3. Once the fluid within the radiator cools and the temperature and pressure decrease, the seal member 16, due to gravity, will move downward away from the fill tube 24 into the fluid 32, as seen in FIG. 2.

Since the seal member 16 is made from a flexible material, the seal member 16 is easily bent upon itself, as shown in phantom in FIG. 2, and inserted into the fill tube 24. The seal member 16 is then pushed beyond the fill tube 24 into the open area 34 within the radiator 30. once in the open area 34, the seal member 16 expands to its original disk shape tethered from the cap 12, as illustrated in FIG. 2. Upon increased temperature and pressure within the radiator 30 and upon removal of the cap 12, the seal member 16 is moved upward into sealing position with fill tube 24, as shown in FIG. 3.

While the above detailed description describes the preferred embodiment of the present invention, it will be understood that the present invention is susceptible to modification, alteration and variation without deviating from the scope and spirit of the subjoined claims.

What is claimed is:

1. A method of securing a radiator cap assembly to a radiator comprising the steps of:

providing a vehicle radiator having a fill tube, said fill tube having two ends defining a length therebetween and a flange at one end extending outwardly from said radiator;

providing a cap assembly including a cap adapted to be secured with said flange of said radiator fill tube, a flexible tethered connected to and extending from said cap at one end, said tether ca-able of bending upon itself and being substantially longer than said length of said fill tube, and a flexible resilient planar disk shape seal being attached to other end of said tether;

banding said seal upon itself such that opposing edges of said flexible resilient seal substantially abut one another forming said seal into an overall cylindrical shape;

placing said seal in said overall cylindrical shape and said tether into the fill tube;

positioning said seal through said fill tube to enable said seal to resiliently spring back into its original planar disk shape configuration to rest upon a surface of a cooling fluid in the radiator; and securing said cap with said radiator fill tube.

2. The method according to claim 1 further comprising pushing said seal through said fill tube into an open area in the radiator.

3. The method according to claim 2 further comprising providing a desired length tether to enable positioning said seal into the radiator.

* * * * *